US008941562B2

(12) United States Patent
Hwang et al.

(10) Patent No.: US 8,941,562 B2
(45) Date of Patent: Jan. 27, 2015

(54) DISPLAY DEVICE

(75) Inventors: Jong-Kwang Hwang, Yongin (KR); Sung-Gyu Kim, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 619 days.

(21) Appl. No.: 13/337,615

(22) Filed: Dec. 27, 2011

(65) Prior Publication Data

US 2013/0002145 A1 Jan. 3, 2013

(30) Foreign Application Priority Data

Jun. 29, 2011 (KR) ..... 10-2011-0063960

(51) Int. Cl.
*G09G 5/00* (2006.01)

(52) U.S. Cl.
USPC ..... 345/76; 345/82; 345/92; 345/102; 345/214

(58) Field of Classification Search
USPC ..... 345/74, 76–78, 82, 92, 90, 100, 102, 345/204, 211–214
See application file for complete search history.

(56) References Cited

FOREIGN PATENT DOCUMENTS

KR 10-2007-0042803 A 4/2007
KR 10-2008-0002184 A 1/2008
KR 10-2009-0067376 A 6/2009
KR 10-0987716 B1 10/2010

*Primary Examiner* — Tuyet Thi Vo
(74) *Attorney, Agent, or Firm* — Knobbe, Martens, Olson & Bear, LLP

(57) ABSTRACT

A display device which adjusts luminance of a display panel is disclosed. The display device senses light which leaks from a display area to a non-display area and adjusts the luminance of the display panel according to the sensed light.

10 Claims, 12 Drawing Sheets

FIG. 8

| | INTENSITY OF LEAKED LIGHT | | LUMINANCE CONTROL SIGNAL |
|---|---|---|---|
| | POSITIVE POLARITY FRAME | NEGATIVE POLARITY FRAME | |
| CASE 1 | HIGH | LOW | FOR INCREASING Vcom |
| CASE 2 | LOW | HIGH | FOR DECREASING Vcom |

DISPLAY DEVICE

This application claims priority from Korean Patent Application No. 10-2011-0063960 filed on Jun. 29, 2011 in the Korean Intellectual Property Office, the disclosure of which is incorporated herein by reference in its entirety.

BACKGROUND

1. Field

The disclosed technology relates to a display device, and more particularly, to a display device which adjusts luminance of a display panel.

2. Description of the Related Technology

In a liquid crystal display (LCD), the polarity of a data voltage is inverted every frame with respect to a common voltage in order to prevent liquid crystals from deteriorating when an electric field in the same direction is continuously applied to a thin-film transistor (TFT) formed in each pixel. This method of driving an LCD by inverting the polarity of the data voltage is referred to as inversion driving.

However, each of the gate and data lines of an LCD has a parasitic resistance and a parasitic capacitance. Accordingly, gate and data voltages are delayed, causing the generation of a kickback voltage. The kickback voltage may cause the voltage difference between the positive polarity data voltage and the common voltage to be different from the difference between the negative polarity data voltage and the common voltage. In addition, the kickback voltage may cause a flicker phenomenon in which the luminance of a displayed image changes every frame.

Furthermore, elements (such as a liquid crystal layer, an organic light-emitting layer and TFTs) of a display panel may not exhibit desired characteristics due to process variation. Accordingly, the display panel may fail to display a desired luminance corresponding to an applied data voltage.

SUMMARY OF CERTAIN INVENTIVE ASPECTS

One inventive aspect is a display device including a display panel which has a display region, a non-display region, a first substrate, a second substrate facing the first substrate, and a leaked light sensing unit disposed between the first substrate and second substrate in the non-display region. The leaked light sensing unit is configured to sense intensity of light leaked from the display region to the non-display region. The display also includes a luminance control signal generator which is electrically connected to the leaked light sensing unit and is configured to generate a luminance control signal to adjust luminance of the display region according to the sensed leaked light intensity.

Another inventive aspect is a display device including a display panel, which has a display region, a non-display region, a first substrate, a second substrate facing the first substrate, a liquid crystal layer disposed between the first substrate and the second substrate in the display region, and a leaked light sensing unit disposed between the first substrate and second substrate in the non-display region and configured to sense an intensity of light leaked from the display region to the non-display region. The display device also includes a luminance control signal generator electrically connected to the leaked light sensing unit and configured to generate a luminance control signal to adjust luminance of the display region according to the intensity of the leaked light sensed by the leaked light sensing unit.

Another inventive aspect is a display device, which includes a display panel, which has a display region, a non-display region, a first substrate, a second substrate facing the first substrate, an organic light-emitting layer disposed between the first substrate and the second substrate in the display region, and a leaked light sensing unit disposed between the first substrate and second substrate in the non-display region and configured to sense intensity of light leaked from the display region to the non-display region. The display device also includes a luminance control signal generator electrically connected to the leaked light sensing unit and configured to generate a luminance control signal to adjust luminance of the display region according to the intensity of the light sensed by the leaked light sensing unit.

BRIEF DESCRIPTION OF THE DRAWINGS

The above and other aspects and features are described with reference to exemplary embodiments and to the attached drawings, in which:

FIG. 8 is a table showing a luminance control signal that varies according to the difference between the data voltage and the common voltage in each of the positive polarity frame and the negative polarity frame.

DETAILED DESCRIPTION OF THE INVENTION

Various aspects and features will now be described more fully hereinafter with reference to the accompanying drawings, in which preferred embodiments are shown. The invention may, however, be embodied in different forms and should not be construed as limited to the embodiments set forth herein. Rather, these embodiments are provided so that this disclosure will be thorough and complete. The same reference numbers generally indicate the same components throughout the specification. In the attached figures, the thickness of layers and regions may be exaggerated for clarity.

Hereinafter, display devices according to exemplary embodiments are described in detail with reference to the attached drawings.

Figure 1:
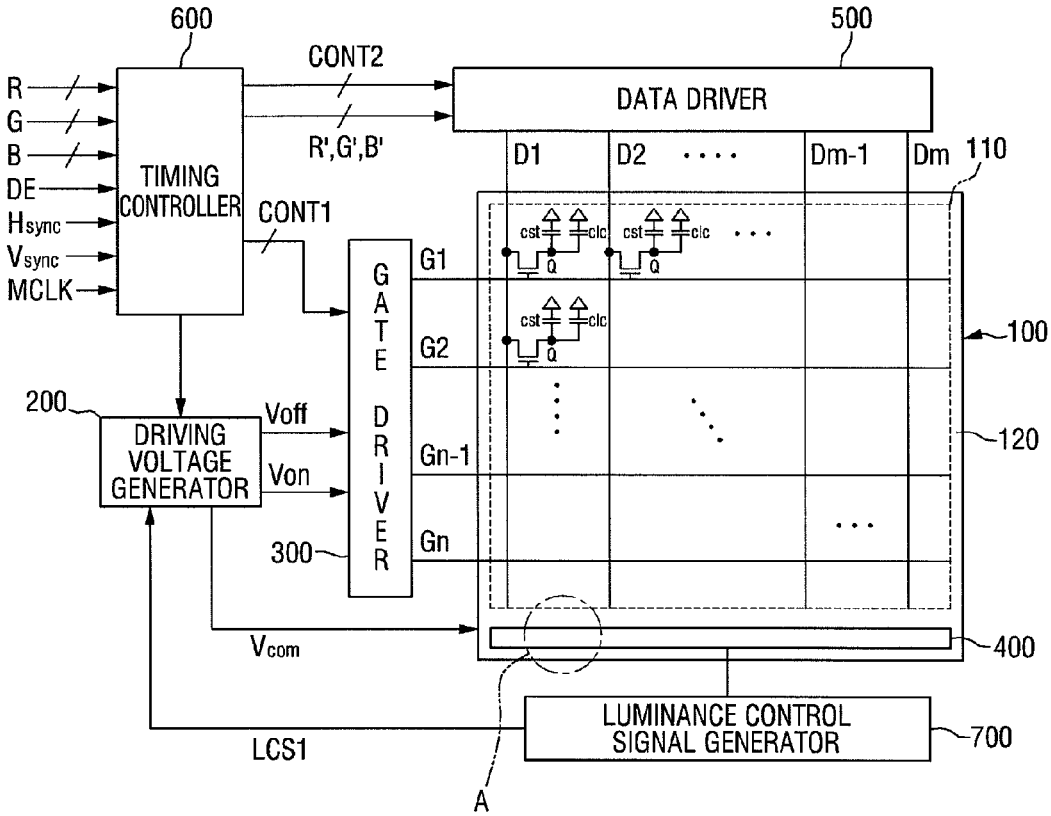
FIG. 1 is a block diagram of a liquid crystal display (LCD) according to an exemplary embodiment.
Figure 2:
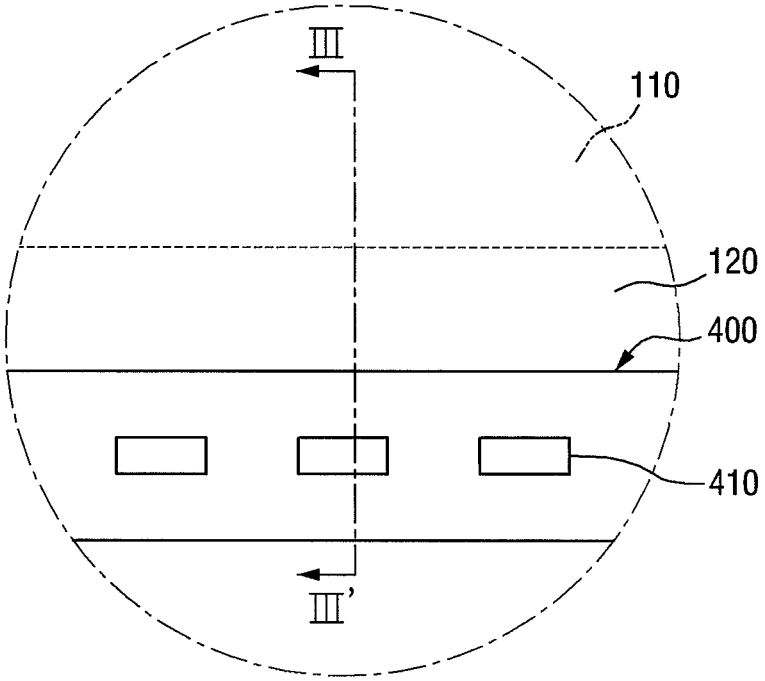
FIG. 2 is an enlarged view of a portion 'A' shown in FIG. 1.
Figure 3:
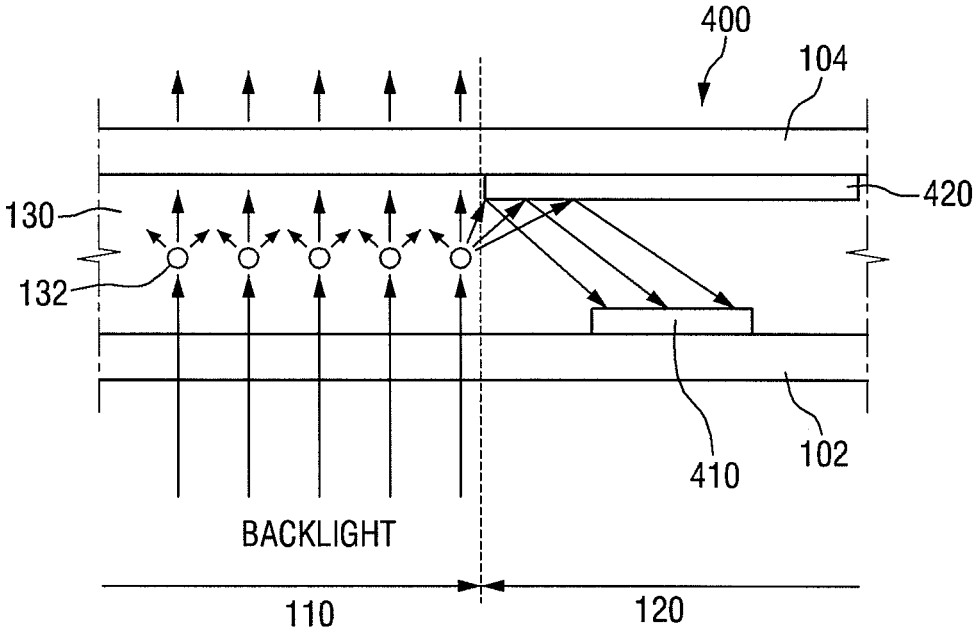
FIG. 3 is a cross-sectional view taken along the line of FIG. 2.

FIG. 1 is a block diagram of a liquid crystal display (LCD) according to an exemplary embodiment. FIG. 2 is an enlarged view of a portion 'A' shown in FIG. 1. FIG. 3 is a cross-sectional view taken along the line III-III' of FIG. 2.

Referring to FIGS. 1 through 3, the LCD according to the current exemplary embodiment includes a display panel 100, a driving voltage generator 200, a gate driver 300, a data driver 500, a timing controller 600, and a luminance control signal generator 700.

The display panel 100 includes a first substrate 102 a second substrate 104 facing the first substrate 102, and a leaked light sensing unit 400 interposed between the first substrate 102 and the second substrate 104.

A display region 110 and a non-display region 120 are defined in the display panel 100. The display region 110 may be defined as a region which displays a desired image by passing all or part of light incident from a backlight unit (not shown). The non-display region 120 may be a region excluding the display region 110 of the display panel 100 and may be formed around the display region 110. The non-display region 120 may also be defined as a region of the display panel 100 which does not receive light from the backlight unit (not shown) or a region which blocks all light emitted from the backlight unit (not shown).

From an equivalent circuit perspective, the display region 110 may include a plurality of display signal lines (G1 through Gn and D1 through Dm) and a plurality of unit pixels which are connected to the display signal lines and are arranged in a matrix.

The display signal lines include a plurality of gate lines G1 through Gn for transmitting gate signals and a plurality of data lines D1 through Dm for transmitting data signals. The gate lines G1 through Gn extend in a row direction and are substantially parallel to each other. The data lines D1 through Dm extend in a column direction and are substantially parallel to each other.

Each unit pixel includes a switching device Q connected to one of the gate lines G1 through Gn and one of the data lines D1 through Dm, a liquid crystal capacitor Clc connected to the switching device Q, and a storage capacitor Cst connected to the switching device Q. The storage capacitor Cst may be omitted when necessary.

The switching device Q uses a pixel electrode of the first substrate 102 and a common electrode of the second substrate 104 as two terminals, and a liquid crystal layer 130 between the two electrodes functions as a dielectric. The pixel electrode is connected to the switching device Q. The common electrode is formed on the whole surface of the second substrate 104, and a common voltage Vcom is applied to the common electrode. The common electrode may alternatively be formed on the first substrate 102. In this case, both of the two electrodes may be linear or bar-shaped.

The leaked light sensing unit 400 is disposed between the first substrate 102 and the second substrate 104 in the non-display region 120 and senses the intensity of light leaked from the display region 110 to the non-display region 120. The leaked light sensing unit 400 may be formed between the first substrate 102 and the second substrate 104 in the non-display region 120 adjacent to the display region 110. For example, the leaked light sensing unit 400 may be formed on a side of the non-display region 120 which is adjacent to the display region 110 and extend in a direction parallel to a boundary between the non-display region 120 and the display region 110. However, the leaked light sensing unit 400 according to the current exemplary embodiment is not always formed on a side of the display panel 100. Although not shown in the drawings, the leaked light sensing unit 400 may also be formed on all sides of the display panel 100.

The leaked light sensing unit 400 may include a plurality of photosensors 410 disposed on the first substrate 102 and a plurality of reflective films 420 disposed above the photosensors 410. Each of the photosensors 410 may generate a different current or voltage signal according to the intensity of light incident thereon. For example, each of the photosensors 410 may be a phototransistor or a photodiode which generates a different current according to the intensity of light incident thereon. The leaked light sensing unit 400 may sense or measure currents generated by the photosensors 410 and output a voltage signal based on the currents. For example, the leaked light sensing unit 400 may output a relatively high voltage when the intensity of incident leaked light is high and output a relatively low voltage when the intensity of the incident leaked light is low.

Each of the photosensors 410 may be a phototransistor which is formed together with the switching device Q of the display region 102 in the same process. Each of the photosensors 410 may be a phototransistor having a source electrode, a drain electrode and a gate electrode respectively made of substantially the same materials as a source electrode, a drain electrode and a gate electrode of a thin-film transistor (TFT) of the switching device Q.

The reflective films 420 may respectively be formed above the photosensors 410 disposed between the first substrate 102 and the second substrate 104 in the non-display region 120. The reflective films 420 may be metal layers (e.g., aluminum, chrome, or silver layers) formed on a surface of the second substrate 104 which faces the first substrate 102.

Referring to FIG. 3, the backlight unit (not shown) located under the first substrate 102 emits light to the display region 110 of the display panel 100. The emitted light passes through the liquid crystal layer 130 of the display panel 100 to display an image. Part of the emitted light may be scattered by liquid crystal molecules 132 in the liquid crystal layer 130, and the emitted light may be scattered at the boundary between the display region 110 and the non-display region 120 so as to leak to the non-display region 120. The leaked light is reflected by the reflective films 420, and the reflected leaked light enters the photosensors 410. That is, the reflective films 420 respectively provide the photosensors 410 with light leaked from the display region 110 to the non-display region 120 by reflecting the leaked light, and each of the photosensors 410 generates an output voltage that corresponds to the intensity of the reflected light.

The driving voltage generator 200 generates a plurality of driving voltages. For example, the driving voltage generator 200 generates a gate-on voltage Von, a gate-off voltage Voff, and the common voltage Vcom. The driving voltage generator 200 may generate the common voltage Vcom whose level has been adjusted in response to a luminance control signal which will be described later. Similarly, the driving voltage generator 200 may generate either or both of the gate-on voltage Von and the gate-off voltage Voff whose level has been adjusted in response to a luminance control signal The gate driver 300 is connected to the gate lines G1 through Gn of the display panel 100 and transmits a gate signal, i.e. the gate-on voltage Von or the gate-off voltage Voff, to the gate lines G1 through Gn.

The data driver 500 is connected to the data lines D1 through Dm of the display panel 100. The data driver 500 generates a plurality of gray voltages based on a plurality of gamma voltages provided by a gamma voltage generator (not shown). The data driver 500 selects one of the generated gray voltages and applies the selected gray voltage to a corresponding unit pixel as a data signal. Generally, the data driver 500 includes a plurality of integrated circuits (ICs).

The timing controller 600 generates control signals for controlling the operations of the gate driver 300 and the data driver 500 and transmits each of the control signals to a corresponding one of the gate driver 300 and the data driver 500.

The display operation of the LCD is described in greater detail below.

The timing controller 600 receives, from an external graphics controller (not shown), red, green and blue image signals R, G, and B and input control signals (e.g., a vertical synchronization signal Vsync, a horizontal synchronization signal Hsync, a main clock signal MCLK, and a data enable signal DE) for controlling the display of the image signals R, G, and B. The timing controller 600 generates gate control signals CONT1 and data control signals CONT2 based on the input control signals. In addition, the timing controller 600 appropriately processes the image signals R, G, and B according to the operating conditions of the display panel 100. Then, the timing controller 600 transmits the gate control signals CONT1 to the gate driver 300 and transmits the data control signals CONT2 and the processed image signals R', G' and B' to the data driver 500.

The gate control signals CONT1 may include a vertical synchronization start signal STV for instructing the start of the output of a gate-on pulse (a gate-on voltage section), a gate clock signal CPV for controlling the output timing of the gate-on pulse, and an output enable signal OE for limiting the width of the gate-on pulse. Of these signals, the output enable signal OE and the gate clock signal CPV may be provided to the driving voltage generator 200.

The data control signals CONT2 may include a horizontal synchronization start signal STH for instructing the start of the input of the image signals R', G', and B', a load signal LOAD for instructing the application of a corresponding data voltage Vdata to a data line, a reverse signal RVS for reversing the polarity of a data voltage Vdata with respect to the common voltage Vcom, and a data clock signal HCLK. Hereinafter, "the polarity of the data voltage Vdata with respect to the common voltage Vcom" will be referred to as "the polarity of the data voltage Vdata."

The data driver 500 sequentially receives the image signals R', G' and B' corresponding to pixels in a row according to the data control signals CONT2 from the timing controller 600, selects a gray voltage corresponding to each of the image signals R', G' and B' from the generated gray voltages, and converts the image signals R', G' and B' into corresponding data voltages Vdata.

The gate driver 300 applies the gate-on voltage Von to the gate lines G1 through Gn according to the gate control signals CONT1 received from the timing controller 600, thereby turning on the switching devices Q connected to the gate lines G1 through Gn. Once the gate-on voltage Von is applied to one of the gate lines G1 through Gn, a row of switching devices Q connected to the gate line may be turned on. While the switching devices Q are on (this period is referred to as '1H' or 'one horizontal period' which is equal to one period of each of the horizontal synchronization signal Hsync, the data enable signal DE and the gate clock signal CPV), the data driver 500 applies each data voltage Vdata to a corresponding one of the data lines D1 through Dm. The data voltages Vdata applied to the data lines D1 through Dm may be applied to corresponding unit pixels via the turned-on switching devices Q, respectively. During a frame, the gate-on voltage Von is sequentially applied to all gate lines G1 through Gn, and thus the data voltages Vdata are applied to all unit pixels, respectively.

The state of the reverse signal RVS transmitted to the data driver 500 is controlled such that a next frame begins when a current frame ends and that the polarity of the data voltage Vdata applied to each unit pixel during the current frame is opposite to that of the data voltage Vdata during a previous frame ("frame inversion"). In some embodiments, within a frame, the polarity of the data voltage Vdata may be changed according to the reverse signal RVS, for example every line ("line inversion"). In addition, data voltages Vdata with different polarities on adjacent columns may be applied to each row of pixels ("dot inversion").

The luminance control signal generator 700 is electrically connected to the leaked light sensing unit 400, generates a luminance control signal LCS1 for controlling the luminance of the display region 110 according to the intensity of leaked light that is sensed, and transmits the generated luminance control signal LCS1 to the driving voltage generator 200. Hereinafter, the luminance control signal LCS1 generated by the luminance control signal generator 700 to control the luminance of the display region 110 is described in further detail with reference to FIGS. 4 through 10.

Figure 4:
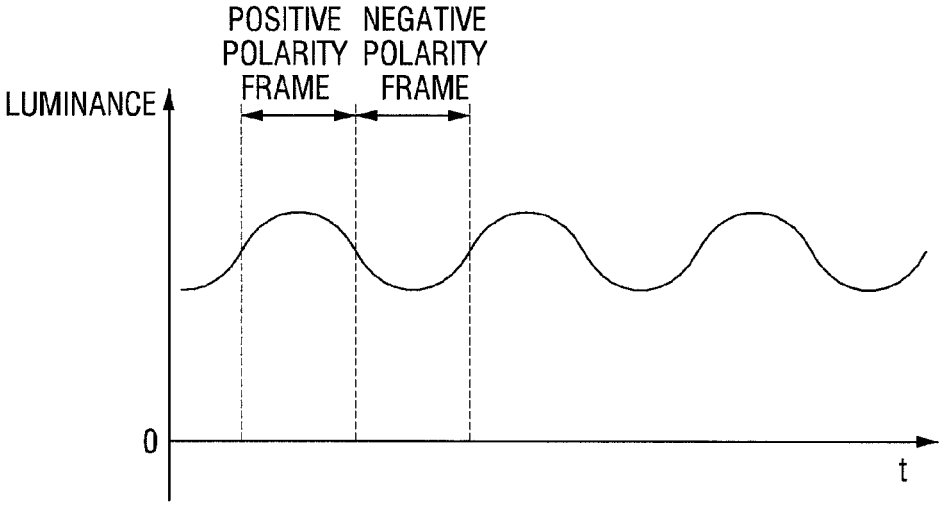
FIG. 4 is a graph illustrating the change in the luminance of a display region when luminance in a positive polarity frame is greater than that in a negative polarity frame.
Figure 5:
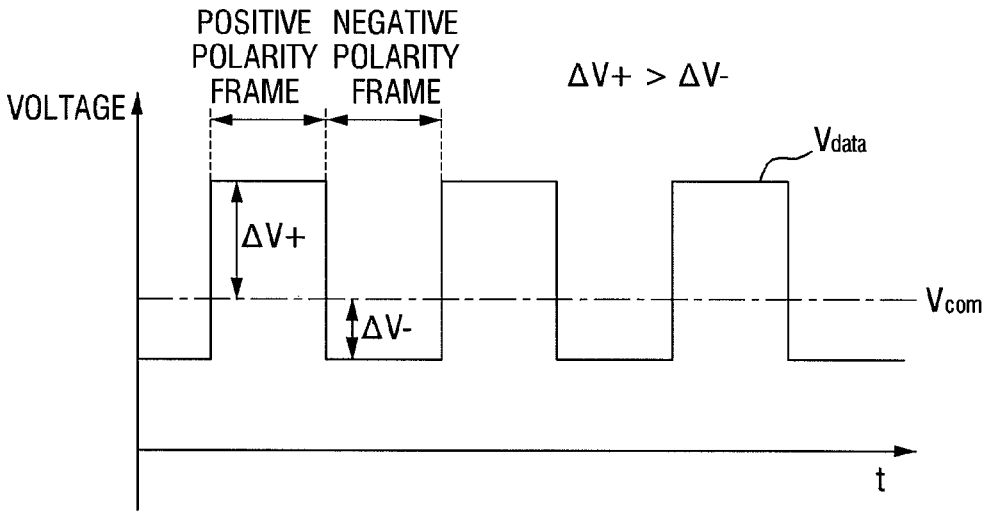
FIG. 5 is a graph illustrating the difference between a data voltage and a common voltage when the luminance in the positive polarity frame is higher than that in the negative polarity frame.
Figure 6:
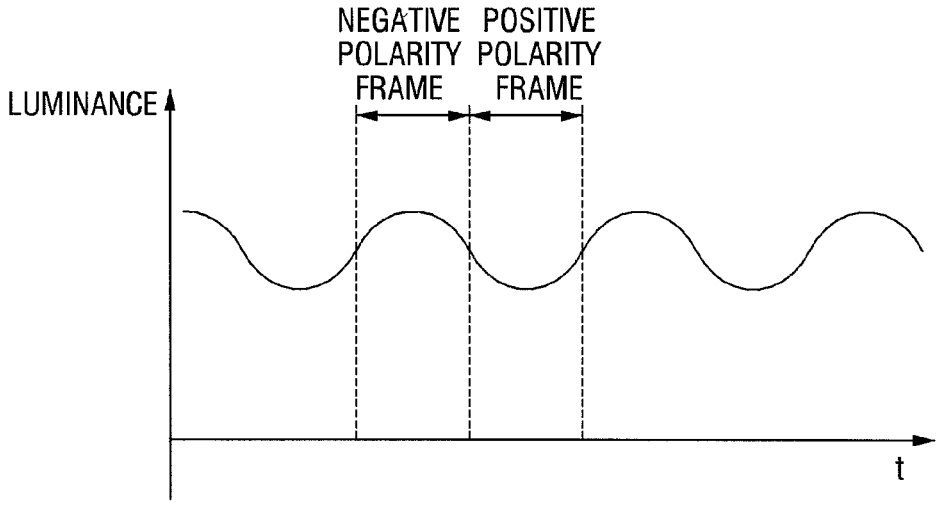
FIG. 6 is a graph illustrating the change in the luminance of the display region when the luminance in the positive polarity frame is less than that in the negative polarity frame.
Figure 7:
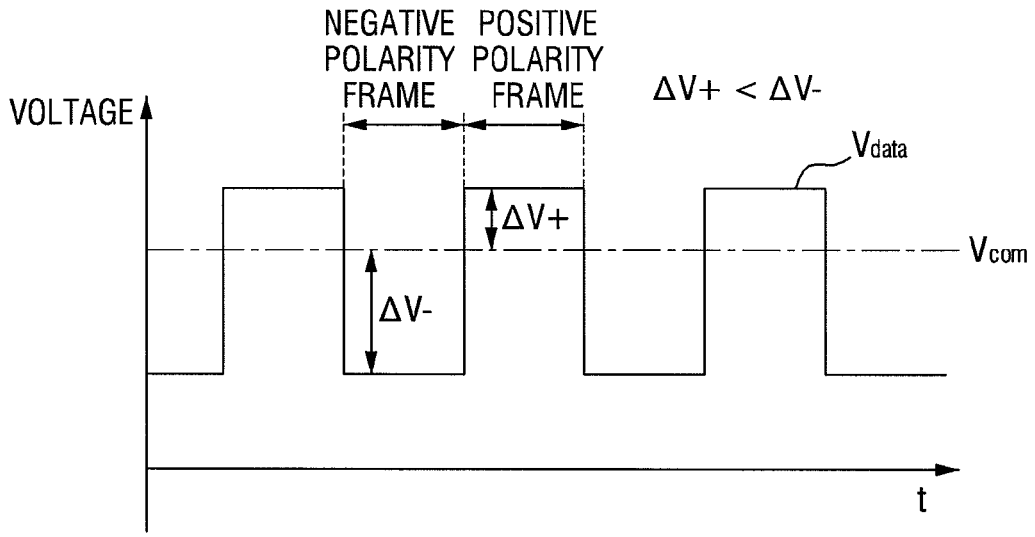
FIG. 7 is a graph illustrating the difference between the data voltage and the common voltage when the luminance in the positive polarity frame is less than that in the negative polarity frame.

FIG. 4 is a graph illustrating the change in the luminance of the display region 110 when luminance in a positive polarity frame is greater than that in a negative polarity frame. FIG. 5 is a graph illustrating the difference between the data voltage Vdata and the common voltage Vcom when the luminance in the positive polarity frame is greater than that in the negative polarity frame. FIG. 6 is a graph illustrating the change in the luminance of the display region 110 when the luminance in the positive polarity frame is less than that in the negative polarity frame. FIG. 7 is a graph illustrating the difference between the data voltage Vdata and the common voltage Vcom when the luminance in the positive polarity frame is less than that in the negative polarity frame. FIG. 8 is a table showing the luminance control signal LCS1 that varies according to the difference between the data voltage Vdata and the common voltage Vcom in each of the positive polarity frame and the negative polarity frame.

Referring to FIGS. 4 through 8, the polarity of the data voltage Vdata applied to each unit pixel is changed every frame. Accordingly, a positive polarity data voltage and a negative polarity data voltage with respect to the common voltage Vcom are alternately applied to each unit pixel on a frame-by-frame basis. Here, a difference $\Delta V+$ between the positive polarity data voltage in the positive polarity frame and the common voltage Vcom may not be equal to a difference $\Delta V-$ between the negative polarity data voltage in the negative polarity frame and the common voltage Vcom. In this case, the luminance of a display image may change every frame, and a flicker phenomenon in which the displayed image flickers may occur.

In this regard, the luminance control signal generator 700 of the LCD according to the current exemplary embodiment observes the change in the luminance of the display region 110 using the leaked light sensing unit 400 and transmits the luminance control signal LCS1 for controlling luminance by adjusting the level of at least one of the common voltage Vcom, the gate-on voltage Von, and the gate-off voltage Voff to the driving voltage generator 200.

If the difference $\Delta V+$ between the positive polarity data voltage and the common voltage Vcom is greater than the difference $\Delta V-$ between the negative polarity data voltage and the common voltage Vcom as shown in FIG. 5, the luminance in the positive polarity frame may be greater than that in the negative polarity frame as shown in FIG. 4. If the difference ΔV+ between the positive polarity data voltage and the common voltage Vcom is smaller than the difference ΔV− between the negative polarity data voltage and the common voltage Vcom as shown in FIG. 7, the luminance in the positive polarity frame may be less than that in the negative polarity frame as shown in FIG. 6.

As summarized in FIG. 8, the luminance control signal generator 700 may generate the luminance control signal LCS1 for increasing the common voltage Vcom when the intensity of leaked light in the positive polarity frame is greater than that of leaked light in the negative polarity frame and may generate the luminance control signal LCS1 for reducing the common voltage Vcom in the opposite case. The driving voltage generator 200 increases or decreases the common voltage Vcom according to the received luminance control signal LCS1. Accordingly, the common voltage Vcom may be adjusted to minimize the difference between the luminance in the positive polarity frame and that in the negative polarity frame. Similarly, at least one of the gate-on voltage Von and the gate-off voltage Voff may be adjusted to minimize the difference between the luminance in the positive polarity frame and that in the negative polarity frame.

Figure 9:
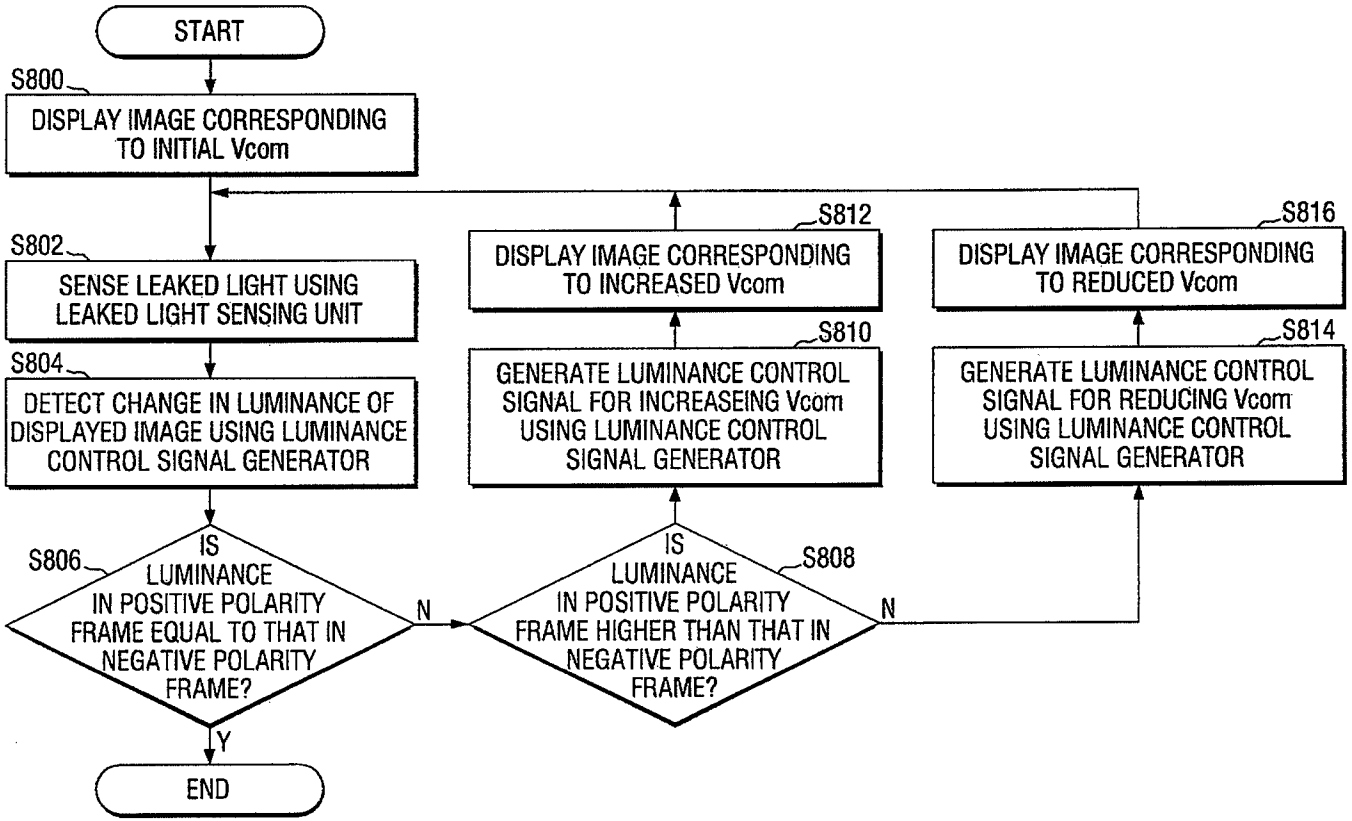
FIG. 9 is a flowchart illustrating a process in which the LCD according to the exemplary embodiment of FIG. 1 adjusts the luminance of the display region.

FIG. 9 is a flowchart illustrating a process in which the LCD according to the exemplary embodiment of FIG. 1 adjusts the luminance of the display region 110. Referring to FIG. 9, the driving voltage generator 200 applies the common voltage Vcom, which is set to an initial value, to the common electrode of the display panel 100, and the display panel 100 displays an image corresponding to the initial common voltage Vcom (operation S800).

The leaked light sensing unit 400 senses the intensity of light leaked to the non-display region 120 of the display panel 100 (operation S802). The luminance control signal generator 700 electrically connected to the leaked light sensing unit 400 detects a change in the luminance of the displayed image based on the intensity of the leaked light (operation S804).

The luminance control signal generator 700 determines whether luminance in a positive polarity frame is equal to that in a negative polarity frame (operation S806). Here, whether the luminance in the positive polarity frame is substantially equal to that in the negative polarity frame may be determined based on whether the difference between the luminances in the positive polarity frame and the negative polarity frame is less than a threshold.

If the luminance in the positive polarity frame is substantially equal to that in the negative polarity frame, the common voltage Vcom is continuously applied as it is to the common electrode. For example, the luminance control of the luminance control signal generator 700 may be terminated. If the luminance in the positive polarity frame is not equal to that in the negative polarity frame, the luminance control signal generator 700 determines whether the luminance in the positive polarity frame is greater than that in the negative polarity frame (operation S808).

If the luminance in the positive polarity frame is greater than that in the negative polarity frame, the luminance control signal generator 700 generates the luminance control signal LCS1 for increasing the common voltage Vcom and transmits the generated luminance control signal LCS1 to the driving voltage generator 200 (operation S810). Accordingly, the driving voltage generator 200 receives the luminance control signal LCS1 for increasing the common voltage Vcom and applies the increased common voltage Vcom to the common electrode of the display panel 100, and the display panel 100 displays an image corresponding to the increased common voltage Vcom (operation S812).

If the luminance in the positive polarity frame is less than that in the negative polarity frame (operation S808), the luminance control signal generator 700 generates the luminance control signal LCS1 for reducing the common voltage Vcom and transmits the generated luminance control signal LCS1 to the driving voltage generator 200 (operation S814). Accordingly, the driving voltage generator 200 receives the luminance control signal LCS1 for reducing the common voltage Vcom and applies the reduced common voltage Vcom to the common electrode of the display panel 100, and the display panel 100 displays an image corresponding to the reduced common voltage Vcom (operation S812). Similarly, at least one of the gate-on voltage Von and the gate-off voltage Voff may be adjusted based on the luminance control signal LCS1 to minimize the difference between the luminance in the positive polarity frame and that in the negative polarity frame.

The leaked light sensing unit 400 again senses the intensity of light leaked to the non-display region 120 of the display panel 100 (operation S802), and subsequent operations are repeated.

Figure 10:
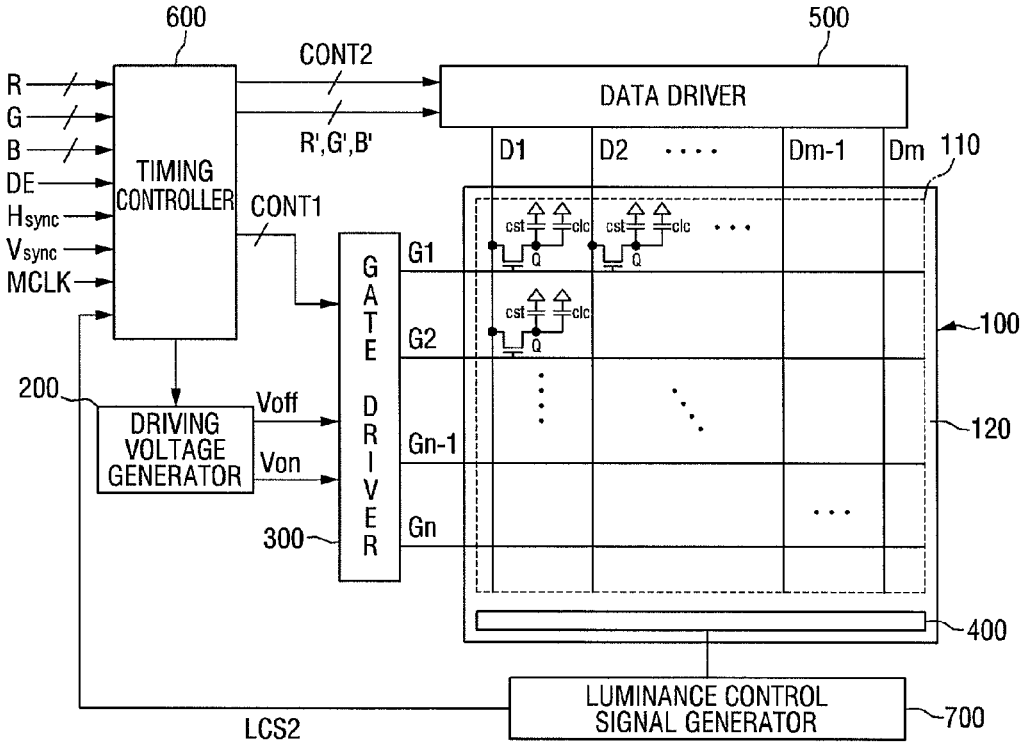
FIG. 10 is a block diagram of an LCD according to another exemplary embodiment.

FIG. 10 is a block diagram of an LCD according to another exemplary embodiment. Referring to FIG. 10, the LCD shown is different from the LCD shown in FIG. 2 in that luminance control signal LCS2 generated by a luminance control signal generator 700 is transmitted to a timing controller 600. Elements substantially identical to those of the previous embodiment are generally indicated by like reference numerals, and any repetitive detailed description thereof may be omitted.

Elements of a display panel 100 such as a liquid crystal layer 130 and TFTs may not exhibit desired characteristics, for example, due to manufacturing process variation. Accordingly, the display panel 100 may not display reference luminance corresponding to the data voltage Vdata.

Therefore, the luminance control signal generator 700 of the LCD may sense the luminance of display region 110 using the intensity of leaked light sensed by a leaked light sensing unit 400 and transmit the luminance control signal LCS2 for adjusting the luminance level of the display region 110 to the timing controller 600.

For example, the luminance control signal generator 700 may measure the intensity of leaked light sensed by the leaked light sensing unit 400, calculate a difference between the reference luminance corresponding to the reference data voltage Vdata and the measured luminance of the display region 110, calculate an amount by which the reference data voltage Vdata is to be corrected based on the calculated difference, and transmit the luminance control signal LCS2 corresponding to the calculated amount to the timing controller 600. The timing controller 600 may process image signals R, G and B according to the operating conditions of the display panel 100 using the luminance control signal LCS2 and generate the processed image signals R', G' and B'. In this way, the luminance variation of the display panel 100 resulting from the process variation of the display panel 100 can be controlled.

While exemplary embodiments have been described above with reference to an LCD display, the present invention is also applicable to various active matrix display devices. An embodiment of an organic light-emitting display device is described with reference to FIGS. 11 and 12.

Figure 11:
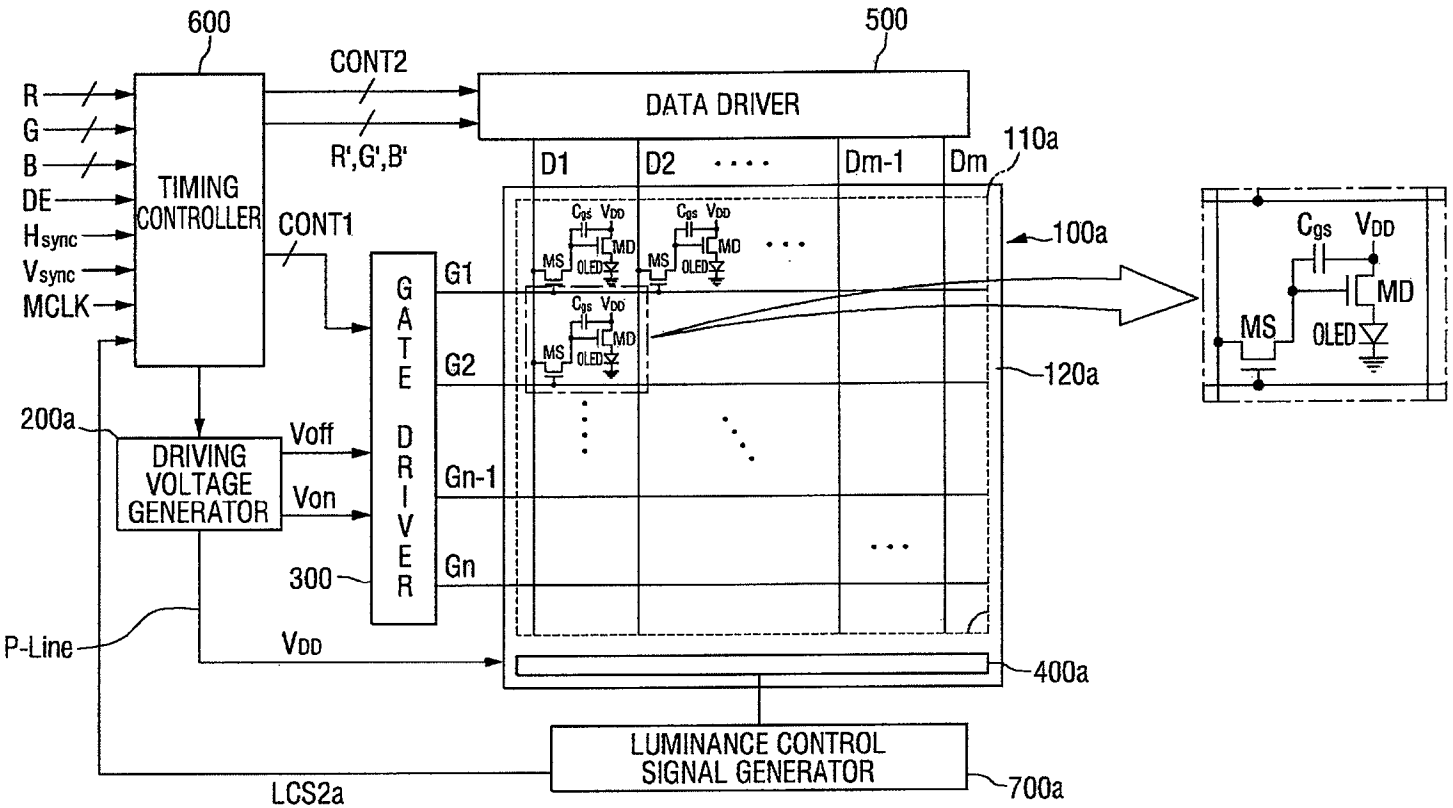
FIG. 11 is a block diagram of an organic light-emitting display device according to an exemplary embodiment.
Figure 12:
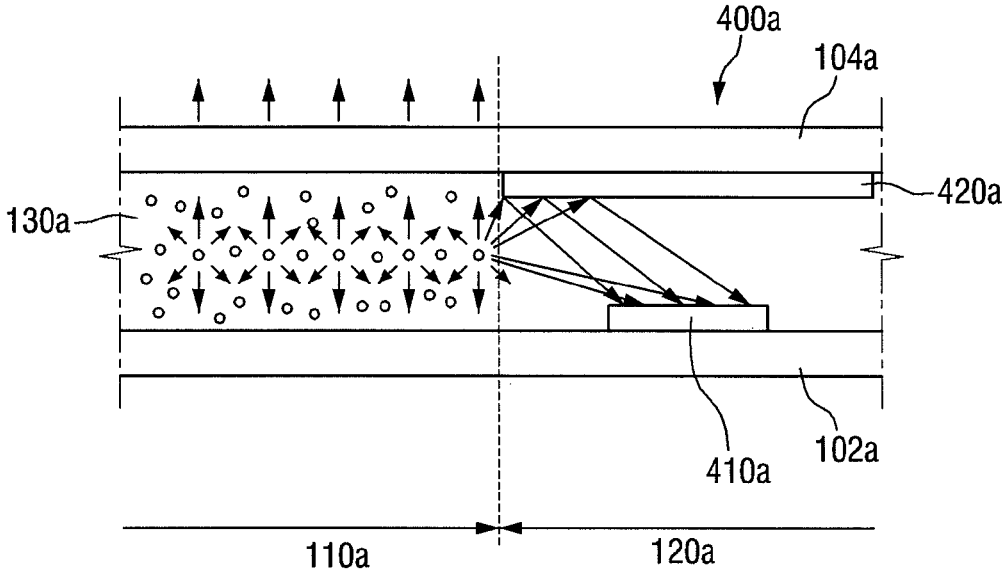
FIG. 12 is a cross-sectional view of the organic light-emitting display device according to the exemplary embodiment of FIG. 11.

FIG. 11 is a block diagram of an organic light-emitting display device according to an exemplary embodiment. FIG. 12 is a cross-sectional view of the organic light-emitting display device according to the exemplary embodiment of FIG. 11.

Referring to FIGS. 11 and 12, the organic light-emitting display device according to the current exemplary embodiment includes an organic light-emitting display panel 100*a*, a driving voltage generator 200*a*, a gate driver 300, a data driver 500, a timing controller 600, and a luminance control signal generator 700*a*. The organic light-emitting display device according to the current exemplary embodiment is different from the LCD according to the exemplary embodiment of FIG. 1 in that, for example, the organic light-emitting display panel 100*a* includes a self-luminous organic light-emitting layer 130*a* and may not include a backlight unit. Elements having the same or similar functions to those of the LCD according to the exemplary embodiment of FIG. 1 are generally indicated by like reference numerals, and a repeated detailed description thereof may be omitted.

The organic light-emitting display panel 100*a* of the organic light-emitting display device includes a plurality of scan lines G1 through Gn for transmitting scan signals, a plurality of data lines D1 through Dm for transmitting data signals in response to the scan signals from the scan lines G1 through Gn, a plurality of unit pixels defined by a plurality of pixels which are defined by the data lines D1 through Dm and the scan lines G1 through Gn, a power line P-Line supplying driving currents to the unit pixels, and a leaked light sensing unit 400*a*. Each unit pixel may include an organic light-emitting device OLED, a driving transistor MD, a switching transistor MS, and a capacitor Cgs.

The display panel 100*a* includes a display region 110*a* and a non-display region 120*a*. The display region 110*a* may be defined as a region which displays a desired image when the organic light-emitting device OLED therein emits light. The non-display region 120*a* may be a region excluding the display region 110*a* of the organic light-emitting display panel 100*a* and may be formed around the display region 110*a*. In addition, the non-display region 120 may be defined as a region which blocks all light leaked from the display region 110*a* among light emitted from the organic light-emitting device OLED The driving transistor MD is connected to the organic light-emitting device OLED and supplies a current for light emission. The amount of current supplied by the driving transistor MD may be controlled by a data voltage signal transmitted to the driving transistor MD via the switching transistor MS. The capacitor Cgs for maintaining the transmitted data voltage signal is connected between a source and a gate of the driving transistor MD.

The power line P-Line is connected to the driving voltage generator 200*a*. In addition, the power line P-Line is connected in parallel to the driving transistor MD of each unit pixel to apply a power supply voltage VDD to the driving transistor MD, thereby supplying a driving current for light emission of the organic light-emitting device OLED.

Referring to FIG. 11, the organic light-emitting device OLED including the organic light-emitting layer 130*a* may be interposed between a first substrate 102*a* and a second substrate 104*a*. When voltages are applied to both terminals of the organic light-emitting device OLED such that a current flows through the organic light-emitting device OLED, the organic light-emitting layer 130*a* emits light of a certain wavelength range due to the transition of an energy state.

Part of the light emitted from the organic light-emitting layer 130*a* leaks from the display region 110*a* to the non-display region 120*a* at a boundary between the display region 110*a* and the non-display region 120*a* of the first substrate 102*a*. The leaked light is reflected by reflective films 420*a*, and the reflected light enters photosensors 410*a*. That is, the reflective films 420*a* respectively provide the photosensors 410*a* with light leaked from the display region 110*a* to the non-display region 120*a* by reflecting the leaked light, and each of the photosensors 410*a* generates an output voltage that varies according to the intensity of the reflected light. The luminance control signal generator 700*a* is electrically connected to the leaked light sensing unit 400*a* and generates a luminance control signal LCS2*a* for adjusting the luminance of the display region 110*a* according to the intensity of leaked light sensed by the leaked light sensing unit 400*a*.

Elements of the organic light-emitting display panel 100*a* such as the organic light-emitting layer 130*a* and TFTs may not exhibit desired characteristics due to process variation. Accordingly, the organic light-emitting display panel 100*a* may not display reference luminance corresponding to a reference data voltage Vdata. Therefore, the luminance control signal generator 700*a* may infer the entire luminance of the display region 110*a* using the intensity of leaked light sensed by the leaked light sensing unit 400*a* and transmit the luminance control signal LCS2*a* for adjusting the luminance level of the display region 110*a* to the timing controller 600.

For example, the luminance control signal generator 700*a* may sense the intensity of leaked light with the leaked light sensing unit 400*a*, calculate a difference between the reference luminance corresponding to the reference data voltage Vdata and the measured luminance of the display region 110*a*, adjust the reference data voltage Vdata based on the calculated difference, and transmit the luminance control signal LCS2*a* for controlling the luminance of the display region 110*a* to the timing controller 600. The timing controller 600 may process image signals R, G and B according to the operating conditions of the organic light-emitting display panel 100*a* by referring to the luminance control signal LCS2*a* and generate the processed image signals R', G' and B'. In this way, the luminance variation of the organic light-emitting display panel 100*a* resulting from the process variation of the organic light-emitting display panel 100*a* can be controlled.

Exemplary embodiments may provide one or more of the following advantages.

Those skilled in the art will appreciate that many variations and modifications can be made to the described embodiments without substantially departing from the principles of the present invention. In addition, the effects of the embodiments are not restricted to those set forth herein.

What is claimed is:

1. A display device comprising:

a display panel including:

a display region, a non-display region, a first substrate, a second substrate facing the first substrate, and a leaked light sensing unit disposed between the first substrate and second substrate in the non-display region, the leaked light sensing unit configured to sense intensity of light leaked from the display region to the non-display region; and a luminance control signal generator which is electrically connected to the leaked light sensing unit and configured to generate a luminance control signal to adjust luminance of the display region according to the sensed leaked light intensity.

2. The display device of claim 1, wherein the leaked light sensing unit is formed on a side of the non-display region to be substantially parallel to a boundary between the non-display region and the display region.

3. The display device of claim 1, wherein the display panel further comprises a liquid crystal layer disposed between the first substrate and the second substrate.

4. The display device of claim 1, wherein the display panel further comprises an organic light-emitting layer disposed between the first substrate and the second substrate.

5. The display device of claim 1, wherein the leaked light sensing unit comprises a plurality of photosensors disposed on the first substrate and a plurality of reflective films respectively disposed on the second substrate.

6. The display device of claim 5, wherein the display panel comprises a plurality of thin-film transistors (TFTs) formed in the display region, each TFT comprising a first source electrode, a first drain electrode and a first gate electrode, wherein each of the photosensors comprises a second source electrode, a second drain electrode and a second gate electrode respectively made of substantially the same materials as the first source electrode, the first drain electrode and the first gate electrode.

7. The display device of claim 1, further comprising a driving voltage generator configured to provide a common voltage to a common electrode of the second substrate, wherein the luminance control signal generator is configured to transmit a luminance control signal to adjust a level of the common voltage to the driving voltage generator, and the driving voltage generator is configured to receive the luminance control signal and to adjust the level of the common voltage.

8. The display device of claim 7, wherein the luminance control signal generator is configured to generate a luminance control signal to increase the common voltage if the intensity of leaked light in a positive polarity frame is greater than that of leaked light in a negative polarity frame and to generate a luminance control signal to reduce the common voltage if the intensity of the leaked light in the positive polarity frame is less than that of the leaked light in the negative polarity frame.

9. The display device of claim 1, wherein the display panel comprises a plurality of data lines formed in the display region and further comprising a data driver configured to transmit data signals to the data lines and a timing controller configured to process an image signal received from an external source and to transmit the processed image signal to the data driver, wherein the luminance control signal generator is configured to transmit to the timing controller a luminance control signal to adjust the luminance of the display region by adjusting levels of the data voltages applied to the data lines, and the timing controller is configured to receive the luminance control signal and to generate the processed image signal.

10. The display device of claim 9, wherein the luminance control signal generator is configured to measure a luminance indicative of the luminance of the entire display region using the intensity of leaked light sensed by the leaked light sensing unit, to calculate a difference between a reference luminance corresponding to a reference data voltage and the measured luminance, to calculate an amount by which the reference data voltage is to be corrected based on the calculated difference, and to transmit a luminance control signal corresponding to the calculated amount to the timing controller.

* * * * *